US011090787B2

(12) United States Patent
Wu

(10) Patent No.: US 11,090,787 B2
(45) Date of Patent: Aug. 17, 2021

(54) REMOTE OPERATING TOOL CAPABLE OF REPLACING VARIOUS WORK UNITS

(71) Applicant: Pi-Liang Wu, Taichung (TW)

(72) Inventor: Pi-Liang Wu, Taichung (TW)

( * ) Notice: Subject to any disclaimer, the term of this patent is extended or adjusted under 35 U.S.C. 154(b) by 270 days.

(21) Appl. No.: 16/278,050

(22) Filed: Feb. 16, 2019

(65) Prior Publication Data

US 2020/0030951 A1 Jan. 30, 2020

(30) Foreign Application Priority Data

Jul. 24, 2018 (TW) ..... 107125600

(51) Int. Cl.
*B25B 25/00* (2006.01)

(52) U.S. Cl.
CPC ..... *B25B 25/005* (2013.01)

(58) Field of Classification Search
CPC ..... B25B 25/00; B25B 25/005; B25B 27/10; B25B 7/00; B25B 7/22
USPC ..... 81/3.07, 3.36, 353, 9.3; 29/235
See application file for complete search history.

(56) References Cited

U.S. PATENT DOCUMENTS 2,796,661 A * 6/1957 Tuttle ..... B25B 27/20 29/235
4,583,671 A * 4/1986 Cressy ..... B25B 7/04 227/144
4,905,550 A * 3/1990 Albrecht ..... B25B 7/02 81/185.1
6,189,190 B1 2/2001 Gillet
6,276,236 B1 * 8/2001 Wu ..... B25B 7/12 81/347
6,339,980 B1 * 1/2002 Woolf ..... B25B 13/58 81/185
6,370,985 B1 4/2002 Wu
7,104,162 B1 9/2006 Wu
8,341,816 B1 * 1/2013 Swinford ..... B25B 27/10 29/237
8,459,152 B2 * 6/2013 Keong ..... B25B 13/08 81/119
9,302,374 B1 * 4/2016 Cusenza ..... B25B 13/58
(Continued)

FOREIGN PATENT DOCUMENTS

CN 108096616 A 6/2018
DE 102011054816 A1 * 5/2013 ..... B25B 25/005
(Continued)

*Primary Examiner* — Joseph J Hail
*Assistant Examiner* — Jonathan R Zaworski

(57) ABSTRACT

A remote operating tool capable of replacing work units contains: a control unit, a connection assembly, and a work unit. The control unit includes a first plier part, a second plier part, and a fixing shaft. The first plier part has a first grip portion and a limitation extension, the second plier part has a second grip portion and an accommodation extension, and the accommodation extension has an aperture. The connection assembly includes a cable and an accommodation sleeve, the cable has a knob, and the accommodation sleeve has a fitting member, wherein the fitting member has a large-diameter section and a small-diameter section. The limitation extension has a first cutout, and the accommodation extension has a second cutout. The control unit further includes a stopper, wherein the defining member is a shell and includes a first chamber.

5 Claims, 14 Drawing Sheets

(56) References Cited

U.S. PATENT DOCUMENTS

| | | | | |
|---|---|---|---|---|
| 2013/0319165 | A1* | 12/2013 | Gillet | B25B 25/005 74/501.6 |
| 2018/0009095 | A1* | 1/2018 | Liao | B25B 7/02 |

FOREIGN PATENT DOCUMENTS

| | | |
|---|---|---|
| TW | 429858 | 4/2001 |
| TW | M240314 | 8/2004 |
| TW | M485122 | 9/2014 |

* cited by examiner

REMOTE OPERATING TOOL CAPABLE OF REPLACING VARIOUS WORK UNITS

FIELD OF THE INVENTION

The present invention relates to a repair tool for vehicles, and more particularly to a remote operating tool which is capable of replacing work units easily, the repair tool contains a control unit, a connection assembly, and a work unit, wherein a first end of the connection assembly is connected with the control unit, a second end of the connection assembly is coupled with the work units, and the control units controls the work unit by ways of the connection assembly.

BACKGROUND OF THE INVENTION

A conventional vehicle contains a pipe made of rubber or other flexible material and configured to deliver a variety of fluids, such as oil, fuel, or water. The vehicle also contains a pipe joint connected with the pipe and configured to store or process the variety of fluids, wherein the pipe is fitted with the pipe joint, and a retainer is fitted on the pipe so as to fix the pipe and the pipe joint securely, thus avoiding a removal of the pipe from the pipe joint.

The retainer is expanded and is moved along the pipe to remove from a fixing position on which the pipe is fitted with the pipe joint, thus removing the pipe from the pipe joint. After fitting the pipe with the pipe joint, the retainer is expended and is moved along the pipe toward the fixing position so as to be removed, thus fixing the pipe with the pipe joint.

A needle-nose pliers or a hand clamp tool is configured to expend a retainer to detach or replace the pipe.

When the retainer is located on a narrow space (such as an engine chamber of the vehicle), the needle-nose pliers cannot be moved close to the retainer to remove the retainer from the pipe. Therefore, equipment proximate to the retainer is removed or the equipment is detachable from the engine room.

A conventional remote operating tool is disclosed in U.S. Pat. Nos. 6,276,236, 6,370,985, and 7,104,162 and contains a control unit, a connection assembly, and a work unit, wherein a first end of the connection assembly is connected with the control unit, and a second end of the connection assembly is coupled with the work unit. The connection assembly is a cable and an accommodation sleeve fitted with the cable, wherein the control unit is driven to urge the cable and the accommodation sleeve to slide so that the connection assembly drives the work unit.

Thereby, the work unit of the remote operating tool is applied to fix or remove the retainer in a narrow space, thus detaching or replacing the pipe easily.

The present invention has arisen to mitigate and/or obviate the afore-described disadvantages.

SUMMARY OF THE INVENTION

The primary objective of the present invention is to provide a remote operating tool capable of replacing work units which contains a control unit, a connection assembly, and a work unit, wherein the control unit is connected with or is removed from the connection assembly so as to replace work units, thus executing different maintenances based on using requirements.

A remote operating tool capable of replacing work units provided by the present invention contains: a control unit, a connection assembly, and a work unit, wherein a first end of the connection assembly is connected with the control unit, a second end of the connection assembly is coupled with the work unit, and the control unit controls the work unit by ways of the connection assembly.

The control unit includes a first plier part, a second plier part, and a fixing shaft, wherein the first plier part is rotatably connected with the second plier part by using the fixing shaft, the first plier part has a first grip portion extending on a first end thereof and has a limitation extension extending on a second end of the first plier part, wherein the first grip portion and the limitation extension are defined between the second grip portion and the accommodation extension, and the first grip portion is proximate to the second grip portion, wherein the limitation extension is adjacent to the accommodation extension and has an orifice defined on a distal end of the limitation extension, and the accommodation extension has an aperture defined on a distal end thereof.

The connection assembly includes a cable and an accommodation sleeve, a first end and a second end of the cable extend out of the accommodation sleeve, the first end of the cable is in connection with the control unit, the second end of the cable is coupled with the work unit, a first end of the accommodation sleeve is connected with the control unit, and a second end of the accommodation sleeve is coupled with the work unit, the first end of the cable is inserted through the aperture and the orifice, and the cable has a knob arranged on the first end thereof, the knob abuts against the limitation extension, the accommodation sleeve has a fitting member fixed on the first end thereof, wherein the fitting member has a large-diameter section and a small-diameter section connected with the large-diameter section, the large-diameter section is fitted with the second end of the accommodation sleeve, the small-diameter section is rotatably connected with the aperture, and the large-diameter section abuts against the accommodation extension, and the small-diameter section extends out of the orifice and connects with a positioning member.

The limitation extension has a first cutout communicating with the orifice and extending to the distal end of the limitation extension, and the accommodation extension has a second cutout communicating with the aperture and extending to the distal end of the accommodation extension, the cable is inserted into/out of the orifice via the first cutout, and the cable is extended into/out of the aperture via the second cutout, wherein a width of the second cutout is less than the small-diameter section.

The control unit further includes a stopper fitted on the limitation extension and configured to stop a removal of the cable from the orifice via the first cutout.

The limitation extension is fitted with a defining member, and the defining member is a shell and includes a first chamber defined in the defining member and extending to a bottom of the defining member so that the distal end of the limitation extension extends into/out of the first chamber from the bottom of the defining member.

The defining member further includes a first plate, a first sheet, and a first coupling piece, wherein the first plate is opposite to the first sheet, a front end of the first coupling plate is connected with the first sheet, a rear end of the first coupling plate is coupled with the first sheet, and the first coupling piece forms on a top and two sides of the defining member, wherein the first plate has a first groove extending to a bottom of the first plate, and the first sheet has a first slot extending to a bottom thereof.

The control unit further includes a protective sheath fitted on the accommodation extension and is a shell, wherein the protective sheath includes a second chamber extending to a bottom thereof so that the distal end of the accommodation extension extends into/out of the second chamber from the bottom of the protective sheath.

The protective sheath further includes a second plate, a second sheet, and a second coupling piece, wherein the second plate is opposite to the second sheet, a front end of the second coupling plate is connected with the second sheet, a rear end of the second coupling plate is coupled with the second sheet, and the second coupling piece forms on a top and two sides of the protective sheath, wherein the second plate has a second groove extending to a bottom of the second plate, and the second sheet has a second slot extending to a bottom thereof.

The protective sheath further includes a trench so that a top of the positioning member extends out of the top of the protective sheath via the trench.

The positioning member is curved and is made of flexible metal wire, wherein the positioning member includes two first extending sections, two second extending section, two third extending sections, and a holding portion, wherein the two first extending sections are symmetrical to each other, the two second extending sections are symmetrical to each other, and the two third extending sections are symmetrical to each other, wherein each of the two first extending sections is formed in a V shape and a top of each first extending section is connected with a bottom of each of the two second extending sections, each second extending section is formed in a V shape and a top of each second extending section is coupled with a bottom of each of the two third extending sections, wherein each third extending section is formed in a V shape and a top of each third extending section is in connection with the holding section, wherein a distance between two first extending sections decreases gradually from two bottoms of the two first extending sections to two tops of the two first extending sections, a distance between two second extending sections increases gradually from two bottoms of the two second extending sections to two tops of the two second extending sections, and a distance between two third extending sections decreases gradually from two bottoms of the two third extending sections to two tops of the two third extending sections, such that a clamp space is defined among the two second extending sections and the two third extending sections.

Accordingly, the control unit is removed from the connection assembly easily without breaking the connection assembly, thus replacing the connection assembly and work units easily.

DETAILED DESCRIPTION OF THE PREFERRED EMBODIMENTS

Figure 1:
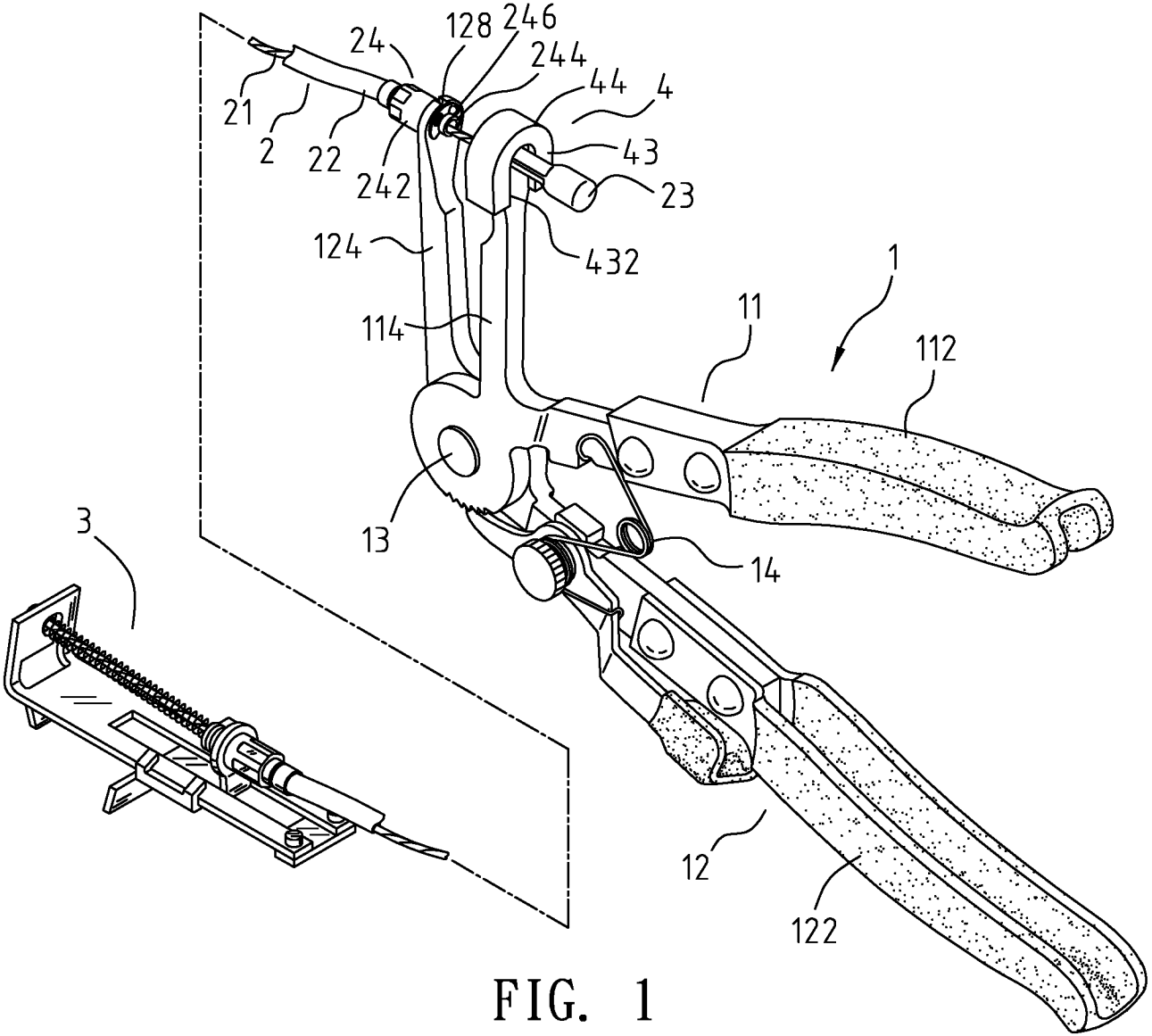
FIG. 1 is a perspective view showing the components of a remote operating tool to a first embodiment of the present invention.

With reference to FIG. 1, a remote operating tool capable of replacing work units according to a first embodiment of the present invention comprises: a control unit 1, a connection assembly 2, and a work unit 3, wherein a first end of the connection assembly 2 is connected with the control unit 1, a second end of the connection assembly 2 is coupled with the work unit 3, and the control unit 1 controls the work unit 3 by ways of the connection assembly 2.

Figure 2:
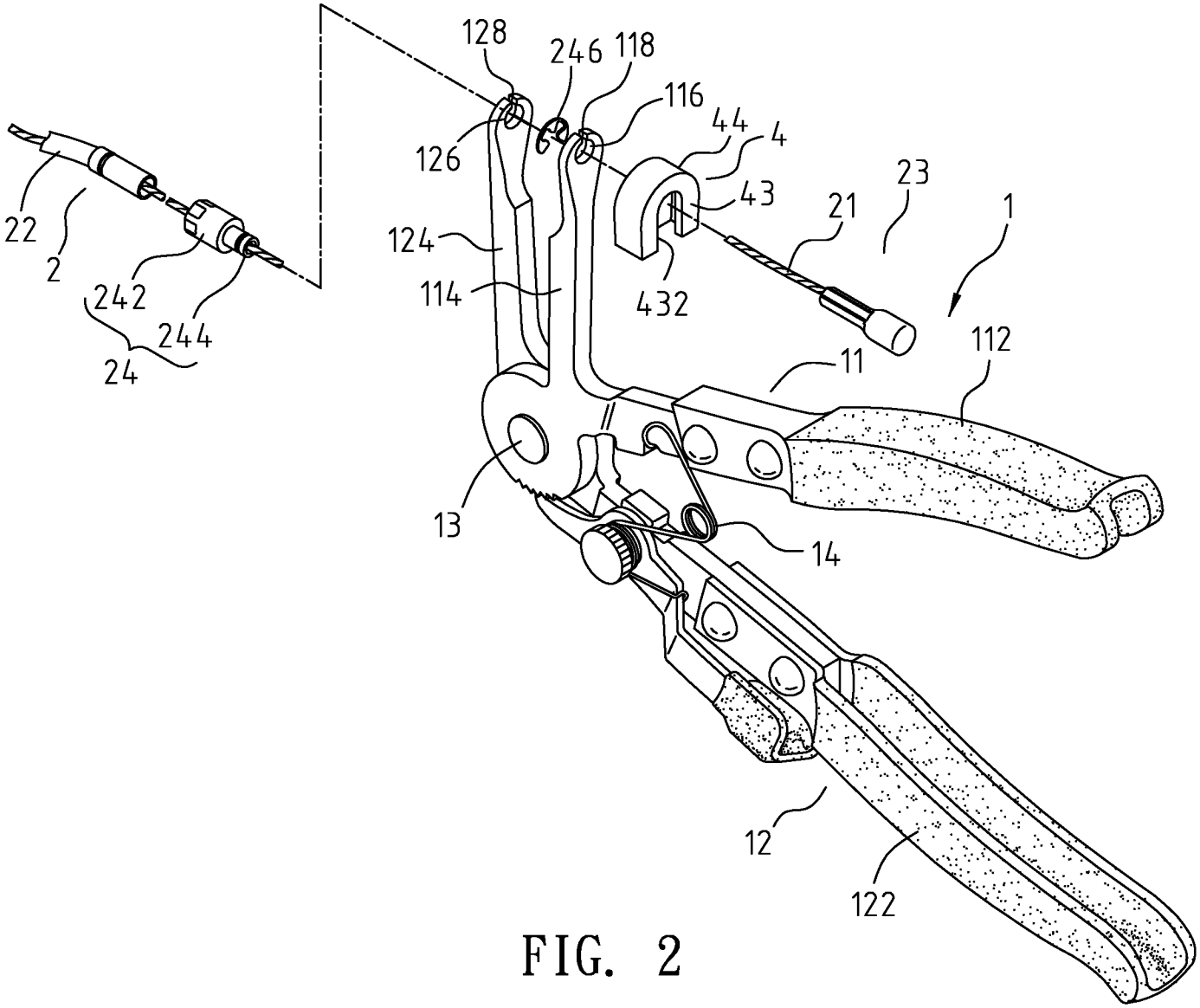
FIG. 2 is a perspective view showing the exploded components of a control unit and a connection assembly of the remote operating tool to the first embodiment of the present invention.
Figure 3:
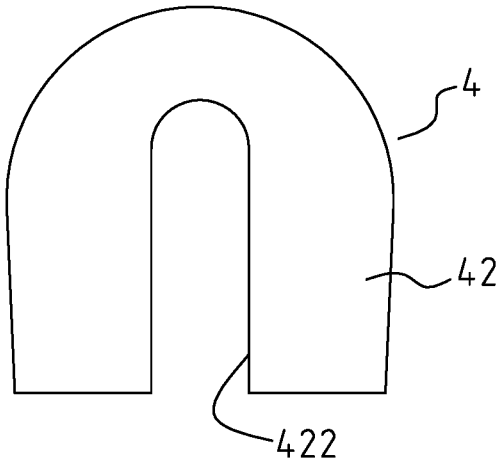
FIG. 3 is a side plan view showing a defining member of the remote operating tool to the first embodiment of the present invention.
Figure 4:
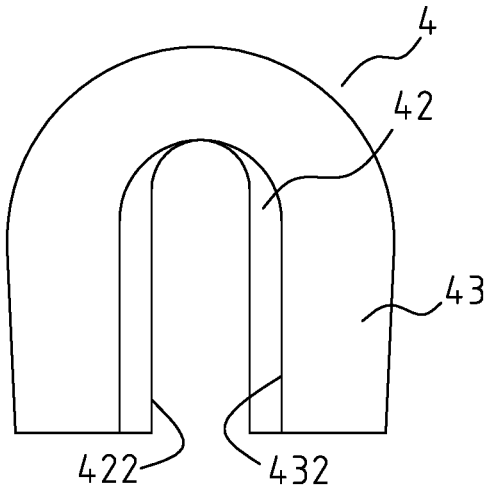
FIG. 4 is another side plan view showing the defining member of the remote operating tool to the first embodiment of the present invention.
Figure 5:
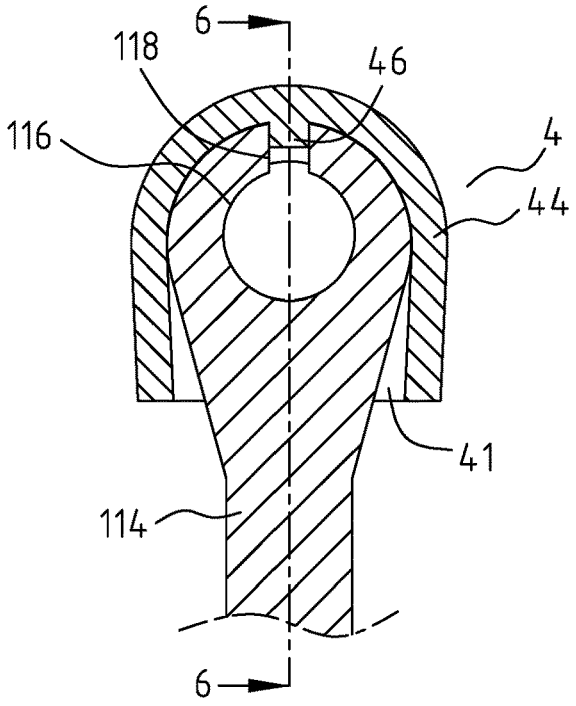
FIG. 5 is a cross sectional view showing the assembly of the defining member and a distal end of a limitation extension of the remote operating tool to the first embodiment of the present invention.
Figure 6:
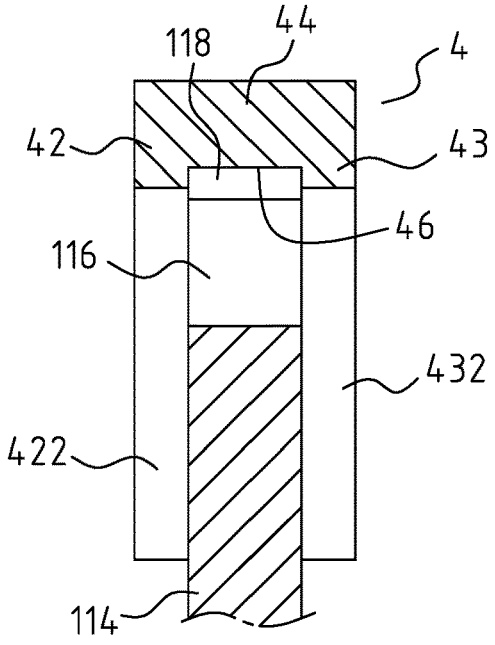
FIG. 6 is a cross sectional view taken along the line 6-6 of FIG. 5.

Referring to FIG. 2, the control unit 1 includes a first plier part 11, a second plier part 12, and a fixing shaft 13, wherein the first plier part 11 is rotatably connected with the second plier part 12 by using the fixing shaft 13 so as to rotate relative to the second plier part 12 along the fixing shaft 13. The control unit 1 further includes a torsion spring 14 mounted between the first plier part 11 and the second plier part 12 and configured to urge the first plier part 11 and the second plier part 12 to move back to two original positions respectively. The first plier part 11 has a first grip portion 112 extending on a first end thereof and has a limitation extension 114 extending on a second end of the first plier part 11. The second plier part 12 has a second grip portion 122 extending on a first end thereof and has an accommodation extension 124 extending on a second end of the second plier part 12, wherein the first grip portion 112 and the limitation extension 114 are defined between the second grip portion 122 and the accommodation extension 124, the first grip portion 112 is proximate to the second grip portion 122, wherein the limitation extension 114 is adjacent to the accommodation extension 124 and has an orifice 116 defined on a distal end of the limitation extension 114, and the accommodation extension 124 has an aperture 126 defined on a distal end thereof, such that when a distal end of the first grip portion 112 is moved to close to a distal end of the second grip portion 122, the distal end of the limitation extension 114 is moved away from the distal end of the accommodation extension 124.

The connection assembly 2 includes a cable 21 and an accommodation sleeve 22, wherein a first end and a second end of the cable 21 extend out of the accommodation sleeve 22, the first end of the cable 21 is in connection with the control unit 1, the second end of the cable 21 is coupled with the work unit 3, a first end of the accommodation sleeve 22 is connected with the control unit 1, and a second end of the accommodation sleeve 22 is coupled with the work unit 3. The first end of the cable 21 is inserted through the aperture 126 and the orifice 116, and the cable 21 has a knob 23 arranged on the first end thereof, wherein a diameter of the knob 23 is more than the orifice 116 so that the knob 23 abuts against the limitation extension 114. The accommodation sleeve 22 has a fitting member 24 fixed on the first end thereof, wherein the fitting member 24 has a large-diameter section 242 and a small-diameter section 244 connected with the large-diameter section 242, the large-diameter section 242 is fitted with the second end of the accommodation sleeve 22, the small-diameter section 244 is rotatably connected with the aperture 126, wherein a diameter of the large-diameter section 242 is more than the aperture 126 so that the large-diameter section 242 abuts against the accommodation extension 124, a distal end of the small-diameter section 244 extends out of the orifice 126 and connects with a positioning member 246, wherein the positioning member 246 is a C-ring configured to rotatably connect the fitting member 24 with the accommodation extension 124, and the fitting member 24 is rotated relative to the accommodation extension 124.

The first grip portion 112 is operated to drive the limitation extension 114 to rotate along the fixing shaft 13, and the second grip portion 122 is operated to drive the accommodation extension 124 to rotate opposite to the limitation extension 114 along the fixing shaft 13. The control unit 1 pulls the cable 21 and the accommodation sleeve 22 to slide oppositely so as to control the work unit 3 to operate by ways of the connection assembly 2. Since the work unit 3 is a well-known art, further remarks are omitted.

The limitation extension 114 has a first cutout 118 communicating with the orifice 116 and extending to the distal end of the limitation extension 114, and the accommodation extension 124 has a second cutout 128 communicating with the aperture 126 and extending to the distal end of the accommodation extension 124. A width of each of the first cutout 118 and the second cutout 128 is more than the cable 21, the cable 21 is inserted into and out of the orifice 116 via the first cutout 118, and the cable 21 is extended into and out of the aperture 126 via the second cutout 128 so that the control unit 1 is connected or is disconnected with the connection assembly 2. A width of the second cutout 128 is less than the small-diameter section 244 so that the small-diameter section 244 does not move into the second cutout 128 from the aperture 126, and the fitting member 24 is rotatably connected with the accommodation extension 124 securely.

The limitation extension 114 of the control unit 1 is fitted with a defining member 4 configured to limit the cable 21 so that the cable 21 does not remove from the limitation extension 114 from the orifice 116 via the first cutout 118, wherein the defining member 4 is made of flexible material.

As shown in FIGS. 2-6, the defining member 4 is a shell and includes a first chamber 41 defined in the defining member 2 and extending to a bottom of the defining member 4 so that the distal end of the limitation extension 114 extends into and out of the first chamber 41 from the bottom of the defining member 4.

The defining member 4 further includes a first plate 42, a first sheet 43, and a first coupling piece 44, wherein the first plate 42 is opposite to the first sheet 43, a front end of the first coupling plate 44 is connected with the first sheet 43, a rear end of the first coupling plate 44 is coupled with the first sheet 43, and the first coupling piece 44 forms on a top and two sides of the defining member 4, wherein the first coupling piece 44 includes a first shoulder 46 extending outward therefrom and being adjacent to the first chamber 41, the first plate 42 has a first groove 422 extending to a bottom of the first plate 42, and the first sheet 43 has a first slot 432 extending to a bottom thereof.

When the limitation extension 114 is not fitted with the defining member 4, the cable 21 is inserted into the aperture 126 and the orifice 116 via the second cutout 128 and the first cutout 118 respectively, and the knob 23 abuts against the limitation extension 114, the small-diameter section 244 is inserted into the aperture 126 from the accommodation extension 124, and the positioning member 246 is located on the accommodation extension 124 to retain with the small-diameter section 244, such that the fitting member 24 is fixed on the accommodation extension 124, and the defining member 4 is fitted on the distal end of the limitation extension 114, thus connecting the connection assembly 2 with the control unit 1.

When the defining member 4 is fitted on the distal end of the limitation extension 114, the distal end of the limitation extension 114 moves into the first chamber 41, the first plate 42, the first sheet 43 and the first coupling piece 44 are proximate to the defining member 4, then the knob 23 moves into the first slot 432 from the bottom of the first sheet 43 and is proximate to a top of the first slot 432. The cable 21 is moved into the first groove 422 from the bottom of the first plate 42 and is adjacent to a top of the first groove 422, wherein the first coupling piece 44 covers the first cutout 118, and the first shoulder 46 retains into the first cutout 118 so that the knob 23 and the cable 21 are limited by the first sheet 43 and the first plate 42 individually, and the cable 21 is stopped by the first coupling piece 44 and does not remove from the limitation extension 114 from the orifice 116 via the first cutout 118, such that the defining member 4 limits the cable 21 and the knob 23, and the distal end of the cable 21 does not remove from the limitation extension 114.

After removing the defining member 4 from the limitation extension 114, the cable 21 is detachable from the limitation extension 114 through the first cutout 118, and the positioning member 246 is removed from the small-diameter section 244 so that the small-diameter section 244 is slid away from the accommodation extension 124, and the cable 21 is removed from the accommodation extension 124 via the second cutout 128, thus detaching the connection assembly 2 from the control unit 2.

Alternatively, the positioning member 246 is removed from the small-diameter section 244, then the defining member 4 is detachable, and the cable 21 is removed from the limitation extension 114 and the accommodation extension 124.

Thereby, the control unit 1 is removed from the connection assembly 2, and the connection assembly 2 is not broken, thus replacing the connection assembly 2 and the work unit 3 easily after the connection assembly 2 or the work unit 3 is broken. Preferably, the control unit 1 is removed from/connected with the connection assembly 2 so as to replace the work units 3, thus executing different maintenances by using the work units 3.

Figure 7:
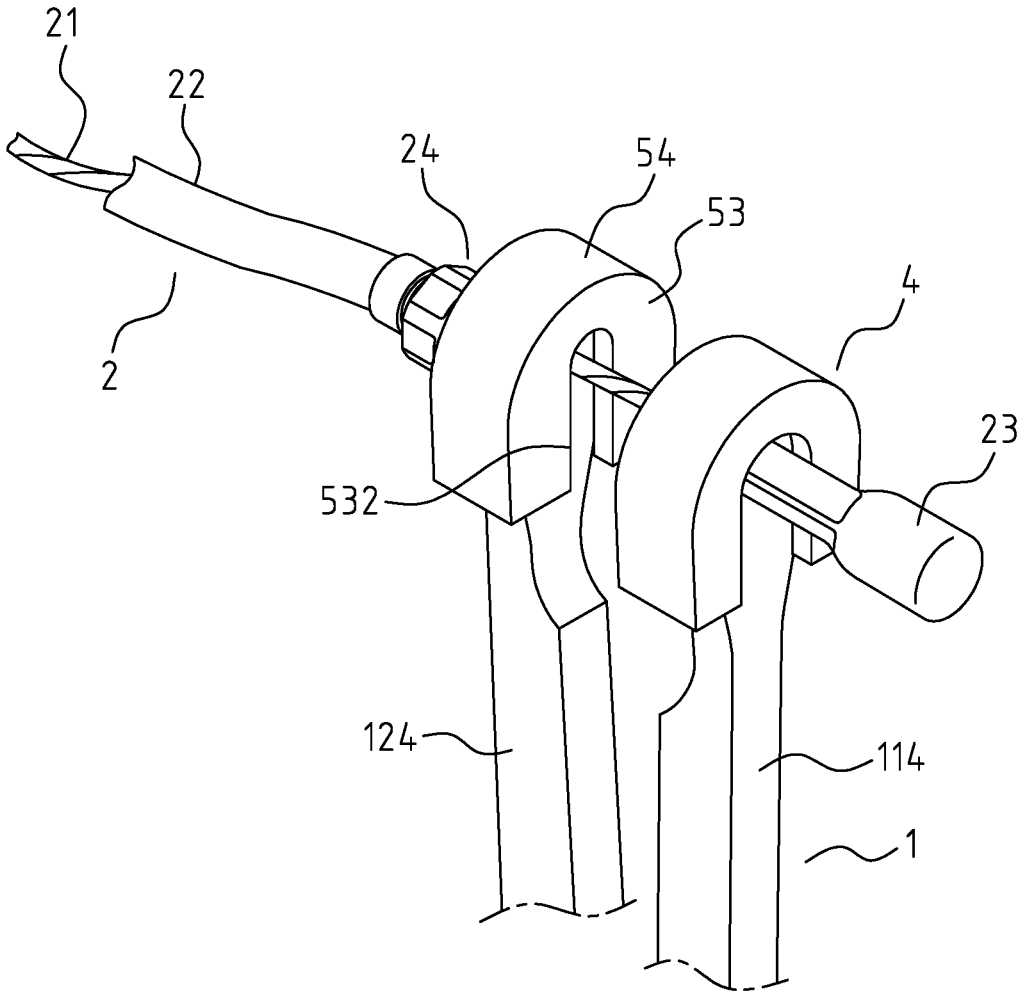
FIG. 7 is a perspective view showing the assembly of a control unit and a connection assembly of a remote operating tool to a second embodiment of the present invention.
Figure 8:
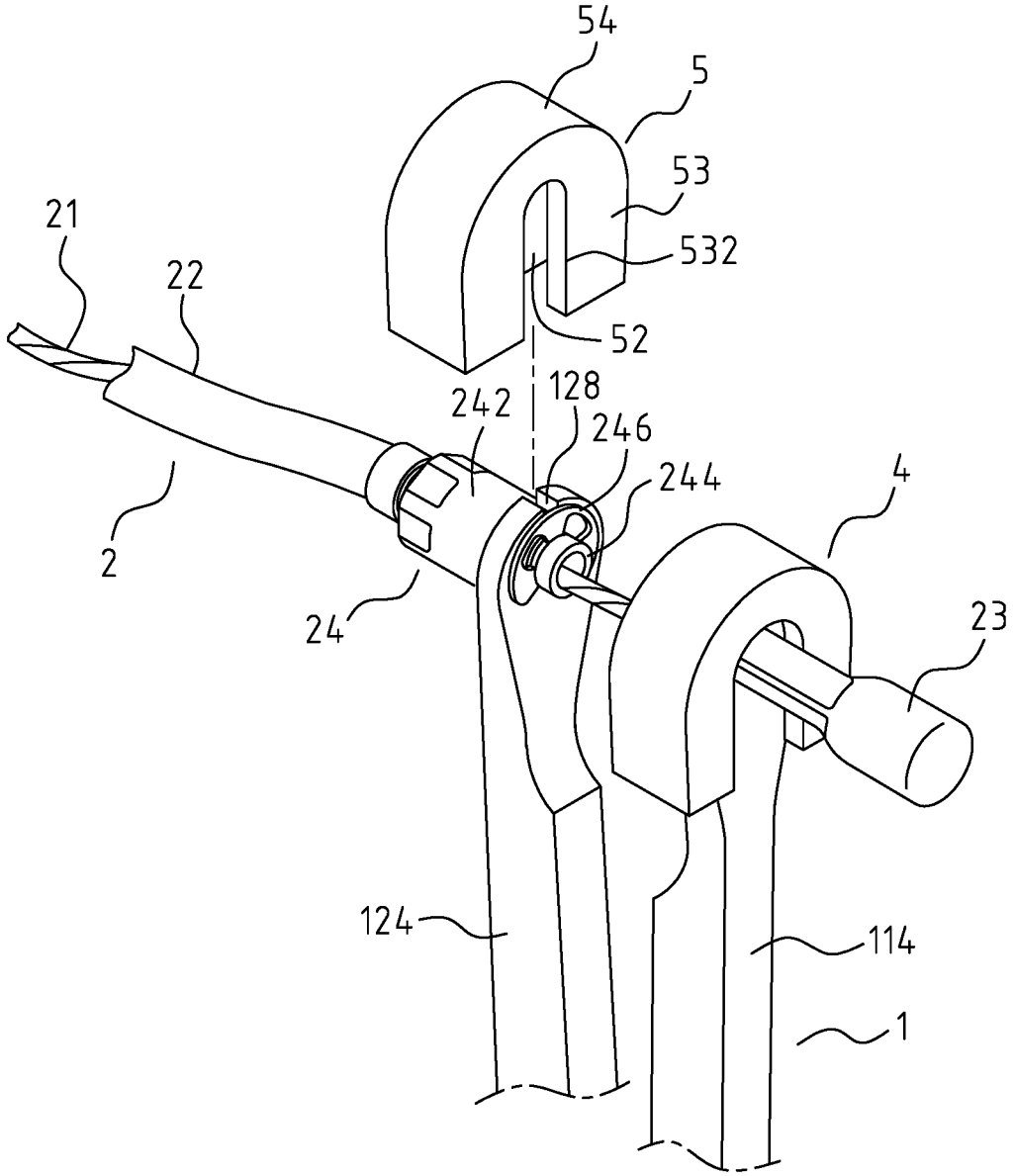
FIG. 8 is a perspective view showing the exploded components of the control unit and the connection assembly of the remote operating tool to the second embodiment of the present invention.
Figure 9:
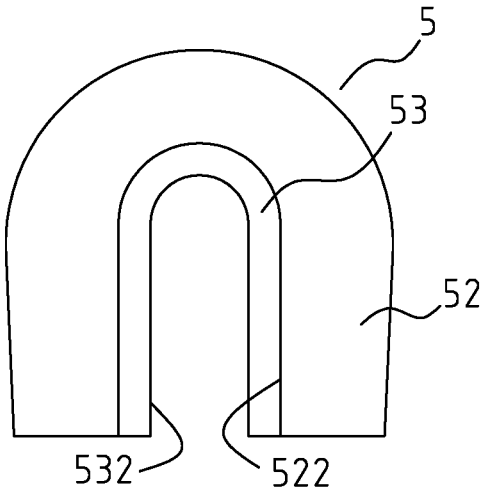
FIG. 9 is a side plan view showing a protective sheath of the remote operating tool to the second embodiment of the present invention.
Figure 10:
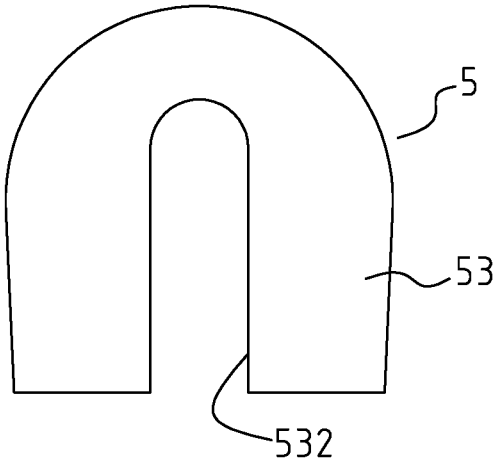
FIG. 10 is another side plan view showing the protective sheath of the remote operating tool to the second embodiment of the present invention.
Figure 11:
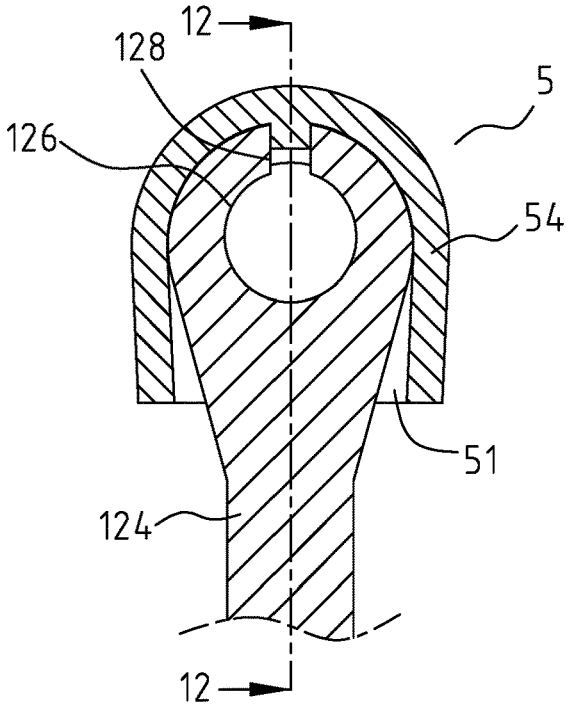
FIG. 11 is a cross sectional view showing the assembly of the protective sheath and a distal end of an accommodation extension of the remote operating tool to the second embodiment of the present invention.
Figure 12:
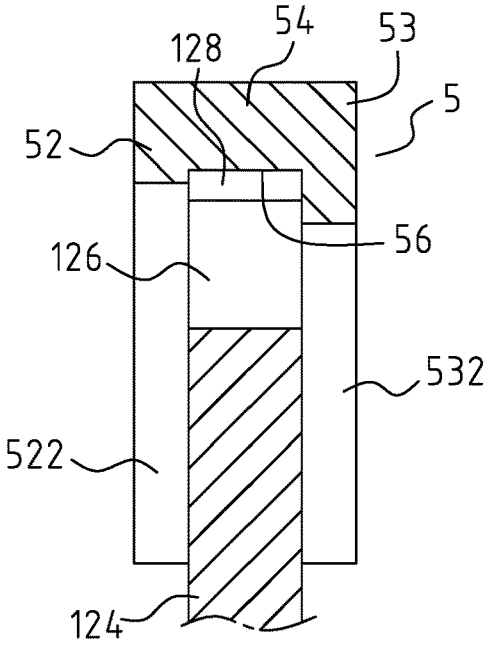
FIG. 12 is a cross sectional view taken along the line 12-12 of FIG. 11.

As shown in FIGS. 7 and 8, a difference of a remote operating tool of a second embodiment from that of the first embodiment comprises: a control unit 1, a connection assembly 2, and a work unit (not shown), wherein the control unit 1 further includes a protective sheath 5 fitted on the accommodation extension 124 and configured to limit the cable 21 so that the cable 21 does not remove from the accommodation extension 124 from the aperture 126 via the second cutout 128, wherein the protective sheath 5 is made of flexible material.

The protective sheath 5 is a shell and includes a second chamber 51 extending to a bottom thereof so that the distal end of the accommodation extension 124 extends into/out of the second chamber 51 from the bottom of the protective sheath 5.

The protective sheath 5 further includes a second plate 52, a second sheet 53, and a second coupling piece 54, wherein the second plate 52 is opposite to the second sheet 53, a front end of the second coupling plate 54 is connected with the second sheet 53, a rear end of the second coupling plate 54 is coupled with the second sheet 53, and the second coupling piece 54 forms on a top and two sides of the protective sheath 5, wherein the second coupling piece 54 includes a second shoulder 56 extending outward therefrom and being adjacent to the second chamber 51, the second plate 52 has a second groove 522 extending to a bottom of the second plate 52, and the second sheet 53 has a second slot 532 extending to a bottom thereof.

When the protective sheath 5 is fitted on the accommodation extension 124, the distal end of the accommodation extension 124 moves into the second chamber 51, the second plate 52, the second sheet 53 and the second coupling piece 54 are proximate to the accommodation extension 124, wherein the small-diameter section 244 of the fitting member 24 moves into the second slot 532 and is proximate to the top of the second slot 532 from the bottom of the second sheet 53, the large-diameter section 242 of the fitting member 24 moves into the second groove 522 and is adjacent to the top of the second groove 522 from the bottom of the second plate 52 so that the second coupling piece 54 covers the second cutout 128, and the second shoulder 56 is retained into the second cutout 128.

Figure 13:
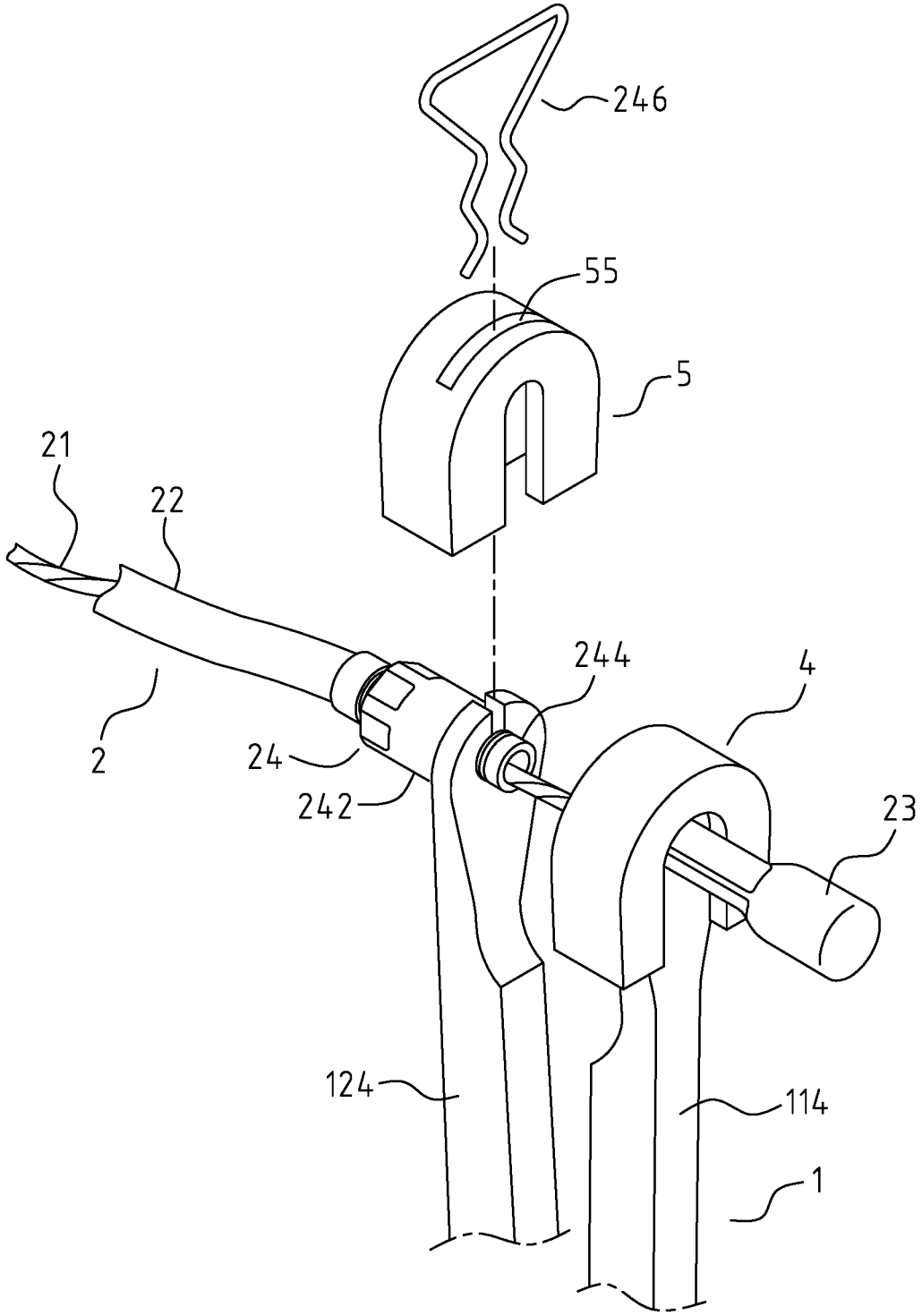
FIG. 13 is a perspective view showing the exploded components of an accommodation extension, a protective sheath, and a positioning member of a remote operating tool to a third embodiment of the present invention.

As illustrated in FIG. 13, a difference of a remote operating tool of a third embodiment from that of the second embodiment comprises: a control unit 1, a connection assembly 2, and a work unit (not shown), wherein the accommodation sleeve 22 has a fitting member 24 fixed on the first end thereof connected with the control unit 1, the fitting member 24 has a large-diameter section 242 and a small-diameter section 244 connected with the large-diameter section 242, the small-diameter section 244 is rotatably inserted through the accommodation extension 124 of the control unit 1 and is connected with a positioning member 246, and the accommodation extension 124 has a protective sheath 5.

Figure 14:
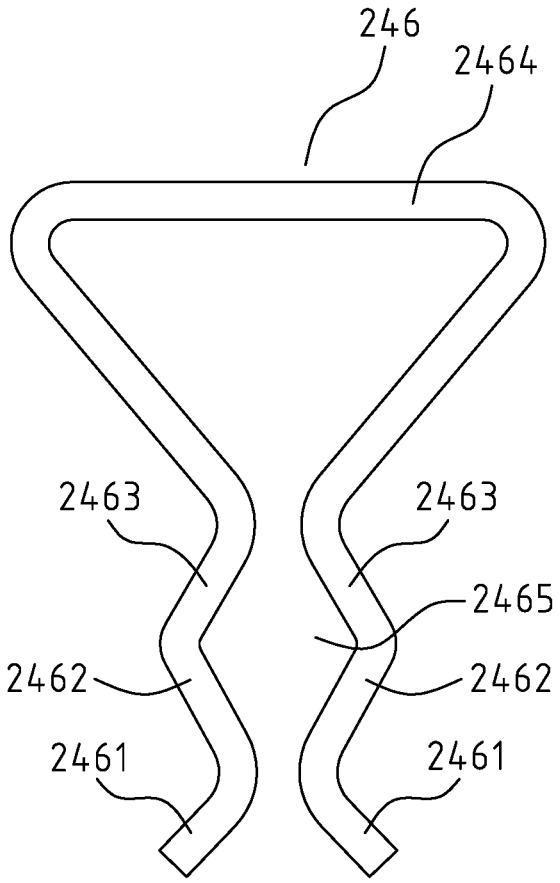
FIG. 14 is a side plan view showing the positioning member of the remote operating tool to the third embodiment of the present invention.

With reference to FIG. 14, the positioning member 246 is curved and is made of flexible metal wire, wherein the positioning member 246 includes two first extending sections 2461, two second extending section 2462, two third extending sections 2463, and a holding portion 2464, wherein the two first extending sections 2461 are symmetrical to each other, the two second extending sections 2462 are symmetrical to each other, and the two third extending sections 2463 are symmetrical to each other, wherein each of the two first extending sections 2461 is formed in a V shape and a top of each first extending section 2461 is connected with a bottom of each of the two second extending sections 2462, each second extending section 2462 is formed in a V shape and a top of each second extending section 2462 is coupled with a bottom of each of the two third extending sections 2463, wherein each third extending section is formed in a V shape and a top of each third extending section 2463 is in connection with the holding section 2464, wherein a distance between two first extending sections 2461 decreases gradually from two bottoms of the two first extending sections 2461 to two tops of the two first extending sections 2461, a distance between two second extending sections 2462 increases gradually from two bottoms of the two second extending sections 2462 to two tops of the two second extending sections 2462, and a distance between two third extending sections 2463 decreases gradually from two bottoms of the two third extending sections 2463 to two tops of the two third extending sections 2463, such that a clamp space 2465 is defined among the two second extending sections 2462 and the two third extending sections 2463.

When the positioning member 246 is retained with the small-diameter section 244, the holding section 2464 is manually gripped and a bottom of the positioning member 246 is moved close to the small-diameter section 244, wherein the two first extending sections 2461 contact with two sides of the small-diameter section 244 respectively so that the small-diameter section 244 stops a reverse movement of the two first extending sections 2461, and the two tops of the two first extending sections 2461 are moved away from each other, hence the small-diameter section 244 is moved into the clamp space 2465 and is retained by the two second extending sections 2462 and the two third extending sections 2463, and the positioning member 246 is retained with the small-diameter section 244.

Referring to FIG. 13, the protective sheath 5 further includes a trench 55 so that a top of the positioning member 246 extends out of the top of the protective sheath 5 via the trench 55.

Thereby, the positioning member 246 is manually retained with or removed from the small-diameter section 244 easily.

Figure 15:
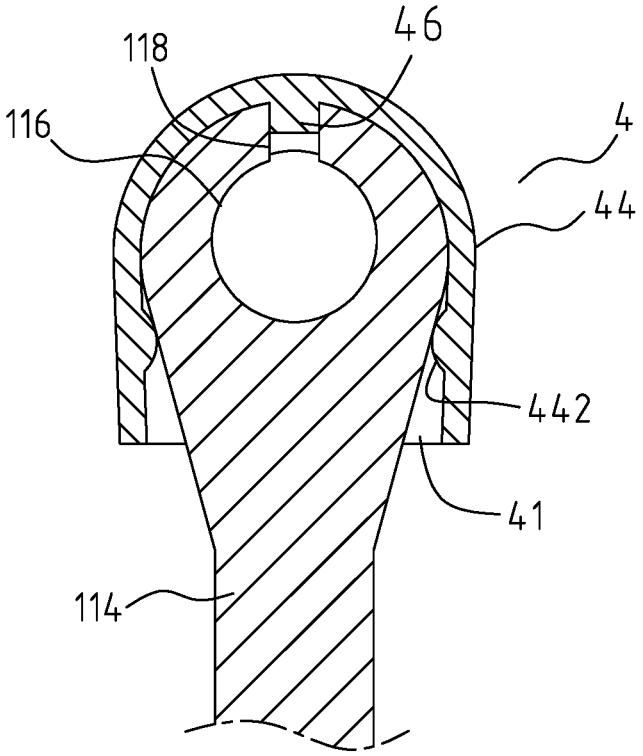
FIG. 15 is a cross sectional view showing the assembly of a defining member and a distal end of a limitation extension of a remote operating tool to a fourth embodiment of the present invention.
Figure 16:
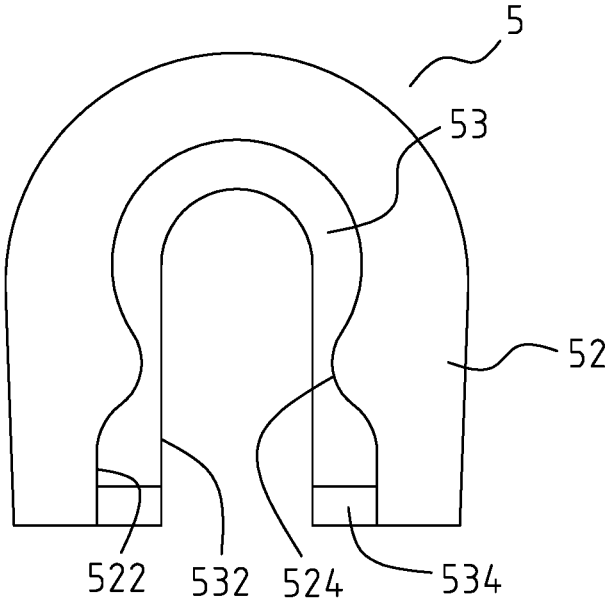
FIG. 16 is a side plan view showing a protective sheath of a remote operating tool to a fifth embodiment of the present invention.
Figure 17:
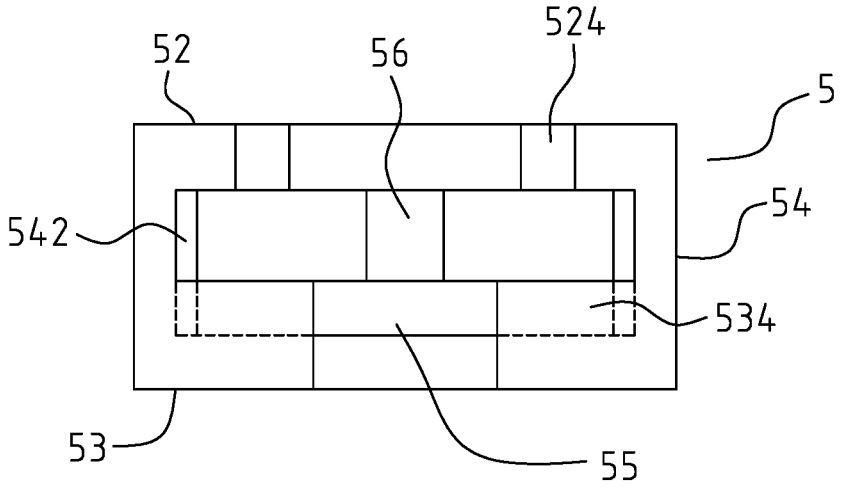
FIG. 17 is another side plan view showing the protective sheath of the remote operating tool to the fifth embodiment of the present invention.
Figure 18:
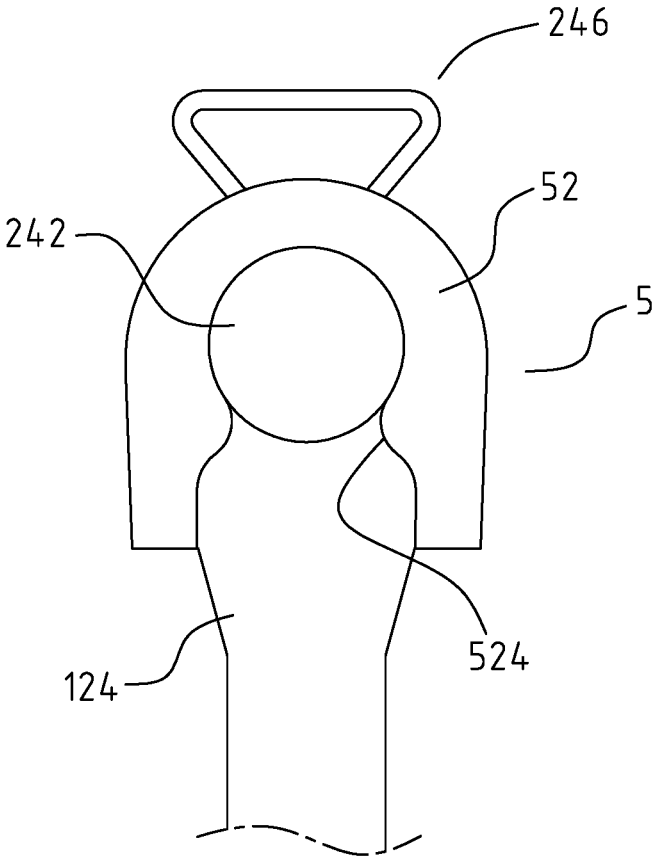
FIG. 18 is a side plan view showing the assembly of the protective sheath and an accommodation extension of the remote operating tool to the fifth embodiment of the present invention.
Figure 19:
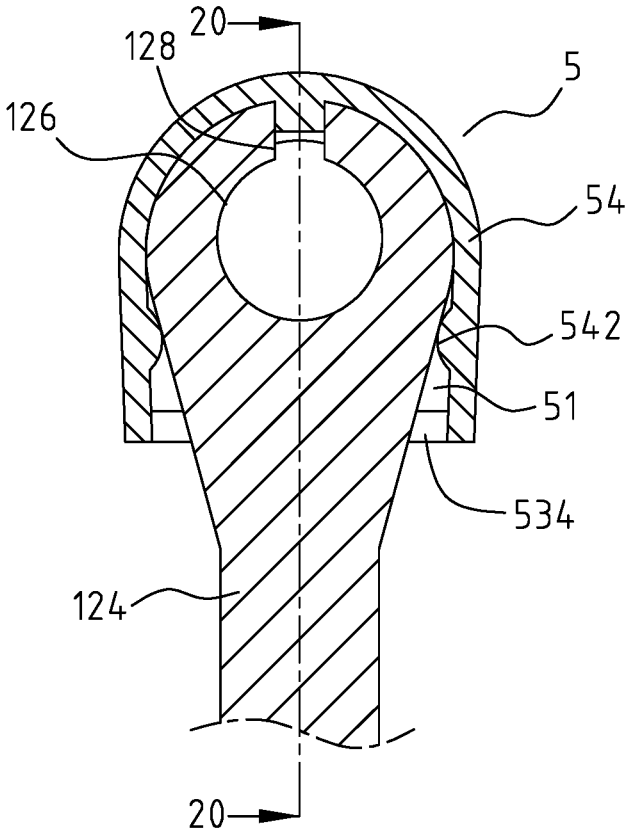
FIG. 19 is a cross sectional view showing the assembly of the protective sheath and a distal end of the accommodation extension of the remote operating tool to the fifth embodiment of the present invention.
Figure 20:
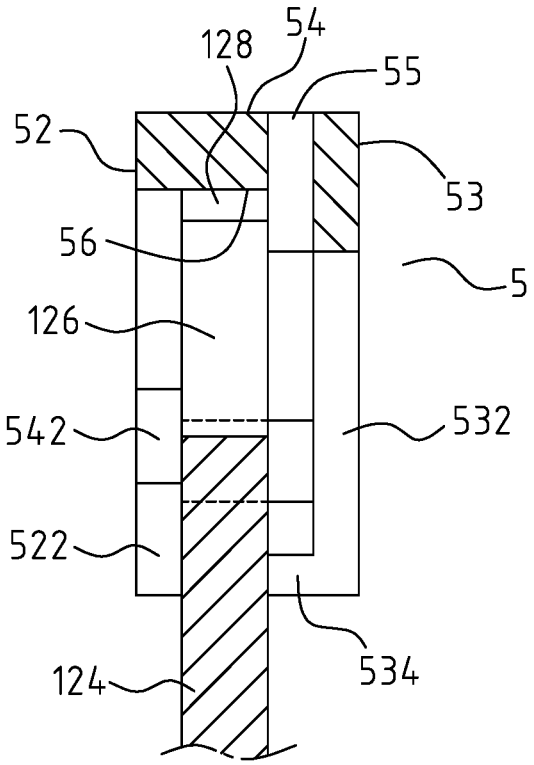
FIG. 20 is a cross sectional view taken along the line 20-20 of FIG. 19.

As shown in FIG. 15, a difference of a remote operating tool of a fourth embodiment from that of the first embodiment comprises: the defining member 4 including two first engagement portions 442 extending from an inner wall of the first coupling piece 44 and formed on two sides of the first chamber 41 individually, such that the two first engagement portions 442 engage the limitation extension 114, thus fitting the defining member 4 on the limitation extension 114 firmly.

As illustrated in FIGS. 16-20, a difference of a remote operating tool of a fifth embodiment from that of the third embodiment comprises: the protective sheath 5 including two second engagement portions 542 extending from an inner wall of the second coupling piece 54 and formed on two sides of the second chamber 51 respectively, such that the two engagement portions 542 engage with the accommodation extension 124, and the protective sheath 5 is fitted on the accommodation extension 124 securely. The second plate 52 of the protective sheath 5 has two abutting portions 524 formed on two sides of the second groove 522 respectively, such that when the protective sheath 5 is fitted on the accommodation extension 124, the two abutting portions 524 contact with a bottom of the large-diameter section 242, and the protective sheath 5 is fitted on the accommodation extension 124 fixedly. The second sheet 53 of the protective sheath 5 has two protrusions 534 extending from a front side thereof so that when the protective sheath 5 is fitted on the accommodation extension 124, the second plate 52 abuts against the accommodation extension 124, and the two protrusions 534 contact with the accommodation extension 124, thus fitting the protective sheath 5 on the accommodation extension 124 stably.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention

What is claimed is:

1. A remote operating tool capable of replacing work units comprising:

a control unit, a connection assembly, and a work unit, wherein a first end of the connection assembly is connected with the control unit, a second end of the connection assembly is coupled with the work unit, and the control unit controls the work unit by ways of the connection assembly;

wherein the control unit includes a first plier part, a second plier part, and a fixing shaft, the first plier part is rotatably connected with the second plier part by using the fixing shaft, the first plier part has a first grip portion extending on a first end thereof and has a limitation extension extending on a second end of the first plier part, the second plier part has a second grip portion extending on a first end thereof and has an accommodation extension extending on a second end of the second plier part, wherein the first grip portion and the limitation extension are defined between the second grip portion and the accommodation extension, and the first grip portion is proximate to the second grip portion, wherein the limitation extension is adjacent to the accommodation extension and has an orifice defined on a distal end of the limitation extension, and the accommodation extension has an aperture defined on a distal end thereof;

wherein the connection assembly includes a cable and an accommodation sleeve, a first end and a second end of the cable extend out of the accommodation sleeve, the first end of the cable is in connection with the control unit, the second end of the cable is coupled with the work unit, a first end of the accommodation sleeve is connected with the control unit, and a second end of the accommodation sleeve is coupled with the work unit, the first end of the cable is inserted through the aperture and the orifice, and the cable has a knob arranged on the first end thereof, the knob abuts against the limitation extension, the accommodation sleeve has a fitting member fixed on the first end thereof, wherein the fitting member has a large-diameter section and a small-diameter section connected with the large-diameter section, the large-diameter section is fitted with the second end of the accommodation sleeve, the small-diameter section is rotatably connected with the aperture, and the large-diameter section abuts against the accommodation extension, the small-diameter section extends out of the orifice and connects with a positioning member;

wherein the limitation extension has a first cutout communicating with the orifice and extending to the distal end of the limitation extension, and the accommodation extension has a second cutout communicating with the aperture and extending to the distal end of the accommodation extension, the cable is inserted into and out of the orifice via the first cutout, and the cable is extended into and out of the aperture via the second cutout, wherein a width of the second cutout is less than the small-diameter section;

wherein the control unit further includes a stopper fitted on the limitation extension and configured to stop a removal of the cable from the orifice via the first cutout;

wherein the limitation extension is fitted with a defining member, and the defining member is a shell and includes a first chamber defined in the defining member and extending to a bottom of the defining member so that the distal end of the limitation extension extends into/out of the first chamber from the bottom of the defining member;

wherein the defining member further includes a first plate, a first sheet, and a first coupling piece, wherein the first plate is opposite to the first sheet, a front end of the first coupling plate is connected with the first sheet, a rear end of the first coupling plate is coupled with the first sheet, and the first coupling piece forms on a top and two sides of the defining member, wherein the first plate has a first groove extending to a bottom of the first plate, and the first sheet has a first slot extending to a bottom thereof.

2. The remote operating tool as claimed in claim 1, wherein the first coupling piece includes a first shoulder extending outward therefrom and being adjacent to the first chamber.

3. The remote operating tool as claimed in claim 1, wherein the control unit further includes a protective sheath fitted on the accommodation extension and is a shell, wherein the protective sheath includes a second chamber extending to a bottom thereof so that the distal end of the accommodation extension extends into/out of the second chamber from the bottom of the protective sheath;

wherein the protective sheath further includes a second plate, a second sheet, and a second coupling piece, wherein the second plate is opposite to the second sheet, a front end of the second coupling plate is connected with the second sheet, a rear end of the second coupling plate is coupled with the second sheet, and the second coupling piece forms on a top and two sides of the protective sheath, wherein the second plate has a second groove extending to a bottom of the second plate, and the second sheet has a second slot extending to a bottom thereof.

4. The remote operating tool as claimed in claim 3, wherein the second coupling piece includes a second shoulder extending outward therefrom and being adjacent to the second chamber.

5. The remote operating tool as claimed in claim 3, wherein the protective sheath including two second engagement portions extending from an inner wall of the second coupling piece and formed on two sides of the second chamber respectively, such that the two engagement portions engage with the accommodation extension; the second plate of the protective sheath has two abutting portions formed on two sides of the second groove respectively, such that the two abutting portions contact with a bottom of the large-diameter section; the second sheet of the protective sheath has two protrusions extending from a front side thereof so that the two protrusions contact with the accommodation extension.

* * * * *